US006887058B2

(12) United States Patent
Fujiwara

(10) Patent No.: US 6,887,058 B2
(45) Date of Patent: May 3, 2005

(54) FLUID MACHINERY

(75) Inventor: Takayoshi Fujiwara, Kanagawa-Ken (JP)

(73) Assignee: Toshiba Carrier Corporation, Tokyo (JP)

( * ) Notice: Subject to any disclaimer, the term of this patent is extended or adjusted under 35 U.S.C. 154(b) by 0 days.

(21) Appl. No.: 10/800,974

(22) Filed: Mar. 16, 2004

(65) Prior Publication Data

US 2004/0184943 A1 Sep. 23, 2004

(30) Foreign Application Priority Data

Mar. 17, 2003 (JP) ..... 2003-072293

(51) Int. Cl.[7] ..... F04C 2/00

(52) U.S. Cl. ..... 418/220; 418/5; 418/15; 418/112; 418/140; 418/149

(58) Field of Search ..... 418/220, 5, 9, 418/15, 112, 140, 149

(56) References Cited

U.S. PATENT DOCUMENTS 6,186,759 B1 * 2/2001 Hayano et al. ..... 418/220
6,589,026 B2 * 7/2003 Fujiwara ..... 418/220

FOREIGN PATENT DOCUMENTS

| | | | | |
|---|---|---|---|---|
| JP | 3-33487 | | 2/1991 | |
| JP | 03145592 A | * | 6/1991 | ..... F04C/18/344 |
| JP | 07027071 A | * | 1/1995 | ..... F04C/18/107 |
| JP | 2002-257068 | | 9/2002 | |
| JP | 2003-3977 | | 1/2003 | |
| JP | 2003097464 A | * | 4/2003 | ..... F04C/18/344 |
| JP | 2004092518 A | * | 3/2004 | ..... F04C/18/344 |

* cited by examiner

*Primary Examiner*—Theresa Trieu
(74) *Attorney, Agent, or Firm*—Pillsbury Winthrop LLP

(57) ABSTRACT

A fluid machinery includes a helical mechanism connected to a driving mechanism, which is driven via a crank shaft. The helical mechanism includes a cylinder defining an inner space, a roller disposed inside the cylinder so as to be rotated in an eccentric manner, the roller being formed with a plurality of helical grooves on an outer peripheral surface, and at least one seal ring groove between respective helical grooves, a plurality of helical blades fitted to the helical grooves so as to be disposed between as inner peripheral surface of the cylinder and the outer peripheral surface of the roller, and at least one seal ring fitted to the seal ring groove so as to tightly seal the inner space as a plurality of operation sections. Furthermore, a plurality of suction ports and a plurality of drain ports, associated with respective operation sections, communicate with each other.

10 Claims, 5 Drawing Sheets

GROOVES 34a AND 34b HAVE THE SAME OR DIFFERENT PITCHES

GROOVES 34a AND 34b HAVE THE SAME OR DIFFERENT PITCHES

FIG. 4 GROOVES 34a AND 34b HAVE THE SAME OR DIFFERENT PITCHES

FIG. 5 GROOVES 34a AND 34b HAVE THE SAME OR DIFFERENT PITCHES

FLUID MACHINERY

BACKGROUND OF THE INVENTION

1. Field of the Invention

The present invention relates to a fluid machinery or machine having a helical mechanism provided with a plurality of operation sections or chambers in a single cylinder.

2. Related Art

In a know art, there is provided a helical compressor having a helical mechanism such as shown in FIG. 6.

With reference to FIG. 6, a reference numeral 70 denotes a helical compressor, which generally comprises a helical mechanism 71 and a driving mechanism 77 such as electric motor. The helical mechanism 71 includes a cylinder or cylinder block 75 in which a roller 73 is disposed. The roller 73 is rotated, through a crank shaft 79, driven by the driving mechanism 77 in an eccentric manner.

The roller 73 is formed, on its outer peripheral surface, with a helical groove 74 into which a helical blade 72 is fitted so as to be disposed in a space between the outer peripheral surface of the roller 73 and an inner peripheral surface of the cylinder block 75.

The helical compressor 70 is provided with a compression section or chamber 76 in which cooling medium such as coolant gas is introduced through a suction port 78, is compressed through an eccentric rotation, i.e., revolution, of the roller 73 which is eccentrically arranged in the cylinder 75 and is drained through a drain port 80.

That is, when the electric motor 77 is driven, the roller 73 is then eccentrically revolved in the cylinder 75, and according to this revolution motion of the roller 73, the compression chamber 76 is displaced helically and then reduced in the inner capacity in accordance with the decreasing of the pitch of the helical groove 74, whereby the cooling medium such as coolant gas of a low pressure introduced through the suction port 78 is helically guided and then drained at an increased high compression pressure.

Further, as mentioned above, such helical compressor is usually provided with the single helical groove 74 having both ends communicated with suction port side and drain port side, respectively.

The conventional helical compressor 71 is provided with one helical groove 74 and one helical blade 72, and accordingly, only a single drain pressure and a single suction pressure are obtained, which limits the type of machinery, thus being inconvenient and disadvantageous.

In order to eliminate such inconvenience or defect, it has been desired to provide a fluid machinery or machine widely utilizable for achieving an industrial requirement.

In response to such requirement, the applicant of the subject application has provided a horizontal type helical compressor as fluid machinery which is provided with a plurality of helical grooves to which a plurality of blades are fitted so as to constitute a plurality of operation sections, which are however, not sectioned in a tightly sealed manner as independent sections, such as disclosed in Japanese Patent Laid-open Publication No. 3977/2003.

SUMMARY OF THE INVENTION

An object of the present invention is therefore to substantially eliminate defects or drawbacks encountered in the prior art mentioned above and to provide a fluid machinery formed with a plurality of helical mechanisms having operation sections which are sectioned in a sealed manner in a single cylinder.

This and other objects can be achieved according to the present invention by providing a fluid machinery comprising a driving mechanism and a helical mechanism connected to the driving mechanism to be driven thereby through a crank shaft connected to the driving mechanism, the helical mechanism comprising:

- a cylinder having an inner space as operation section;
- a roller disposed inside the cylinder so as to be rotated by the driving mechanism through the crank shaft in an eccentric manner, the roller being formed with a plurality of helical grooves on an outer peripheral surface thereof and at least one seal ring groove formed on the outer peripheral surface of the roller at a portion between respective helical grooves;
- a plurality of helical blades fitted to the helical grooves so as to be disposed between an inner peripheral surface of the cylinder and the outer peripheral surface of the roller;
- at least one seal ring fitted to the seal ring groove so as to tightly seal a space between the inner peripheral surface of the cylinder and the outer peripheral surface of the roller so as to define the inner space of the cylinder into a plurality of operation sections; and
- a plurality of suction ports formed to the respective operation sections and a plurality of drain ports formed to the respective operation sections so that the corresponding suction port and drain port are communicated with each other.

In a preferred embodiment, the seal ring may have a cutout and end portions of the cutout are provided with staged portions which are tightly mated together when both end portions are assembled as a seal ring. The seal ring is formed of a resin material and, preferably, of a fluororesin.

The helical grooves of the respective operation sections may have same or different winding directions. The helical grooves of the respective operation sections have same or different winding pitches.

The driving mechanism and the helical mechanism may be disposed in an outer cylindrical seal casing. The seal casing is replaced with a cylindrical cover having opened end portions.

The fluid machinery may be composed as a vertical type helical compressor.

According to the fluid machinery of the present invention of the structures mentioned above, a plurality of helical mechanisms including operation sections, i.e., operation chambers, are formed in a single cylinder, so that the wide usage of such fluid machinery can be realized. In a design in which the helical shapes such as winding directions, pitches or like differs from each other, the fluid machinery can be operated at different compressing ratios.

The location of the seal ring can prevent the fluid from leaking between adjacent operation sections, enhancing the compressing efficiency.

The nature and further characteristic features of the present invention will be made more clear from the following descriptions with reference to the accompanying drawings.

BRIEF DESCRIPTION OF THE DRAWINGS

In the accompanying drawings:

FIG. 2 shows a seal ring to be applied to the helical compressor of FIG. 1, in which

DESCRIPTION OF THE PREFERRED EMBODIMENT

A preferred embodiment of the present invention will be described hereunder with reference to the accompanying drawings.

Figure 1:
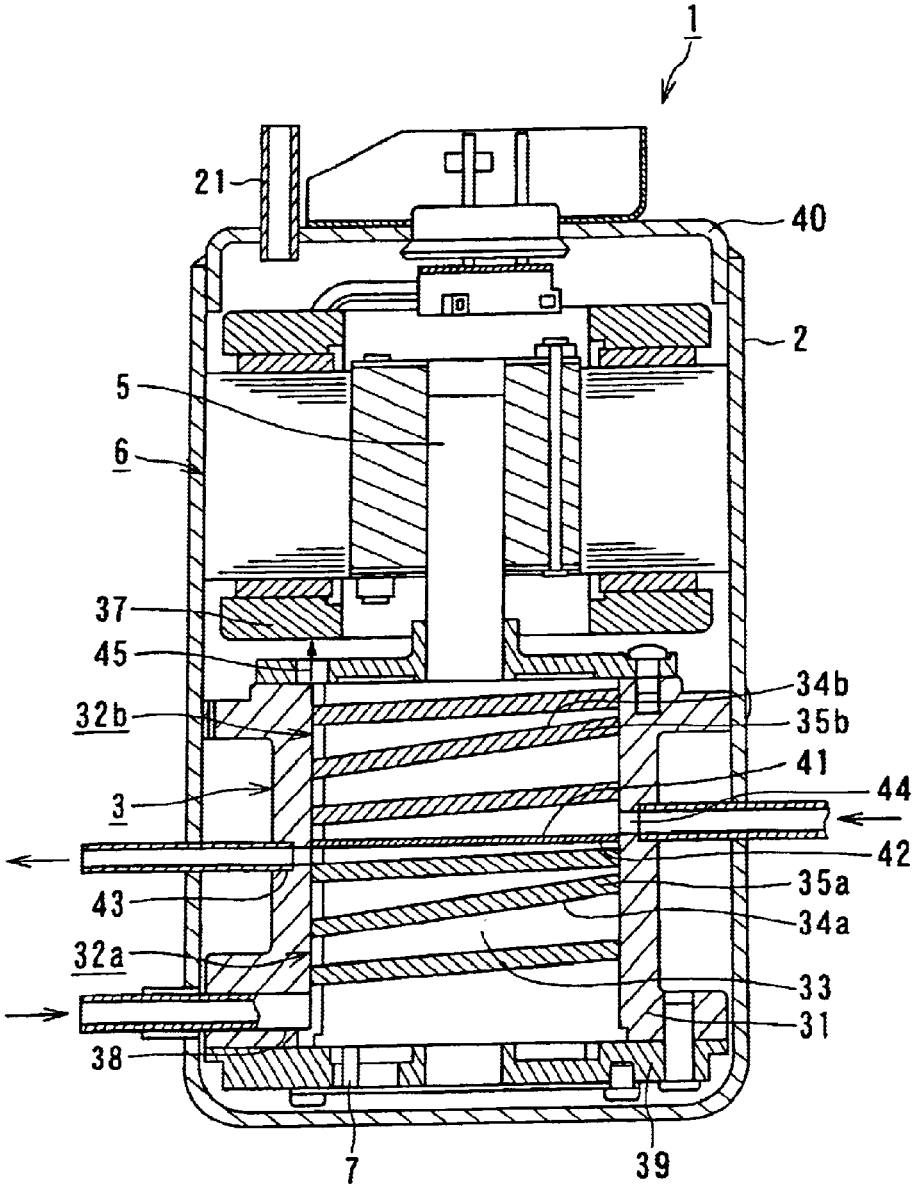
FIG. 1 is an elevational section of a helical compressor as a fluid machinery according to a first embodiment of the present invention.

First, with reference to FIG. 1, showing a first embodiment of a fluid machinery or machine according to the present invention, the fluid machinery of this embodiment is a vertical-type helical compressor 1. This helical compressor 1 comprises an outer seal casing 2, a helical mechanism 3 disposed inside the casing 2 and a driving mechanism 6, which is also disposed inside the casing 2, as electric motor which drives the helical mechanism 3 through a crank shaft 5.

The helical mechanism 3 is provided with a single cylinder, i.e., cylinder block 31 and sectioned into a plurality of helical mechanisms provided with operation sections such as two in the illustrated embodiment, i.e., a lower operation section 32*a* and an upper operation section 32*b*. These lower and upper operation sections 32*a* and 32*b* are sectioned, as independent operation chambers, by a seal ring 41, which will be mentioned in detail hereinlater with reference to FIGS. 2 and 3.

In the cylinder block 31, there is also disposed a roller 33 in a manner eccentric from a central axis of the cylinder block 31. A plurality of helical grooves, two in this embodiment, 34*a* and 34*b* are formed to the outer peripheral surface of the roller 33 in the regions of the lower and upper operation sections 32*a* and 32*b* of the cylinder 31, respectively, and a plurality of helical blades (two in this embodiment) 35*a* and 35*b* are also fitted in the helical grooves 34*a* and 34*b*, respectively, between the inner peripheral surface of the cylinder block 31 and the outer peripheral surface of the roller 33.

A seal ring groove 42 is formed to the outer periphery of the roller 33 at a portion between the locations of the helical grooves 34*a* and 34*b* formed to the lower and upper operation sections 32*a* and 32*b*, respectively. The seal ring 41 is fitted to the seal ring groove 42 to be freely mounted or dismounted. The seal ring groove 42 is not helical and substantially horizontal around the roller 33 in its vertical view.

Figure 2A:
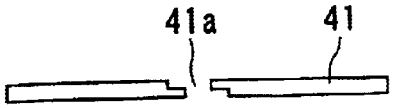
FIG. 2A is an illustrated front view of the seal ring, before fitting, showing a cutout of the seal ring
Figure 2B:
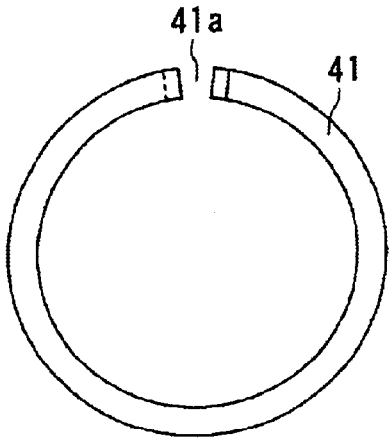
FIG. 2B is a plan view thereof.
Figure 3:
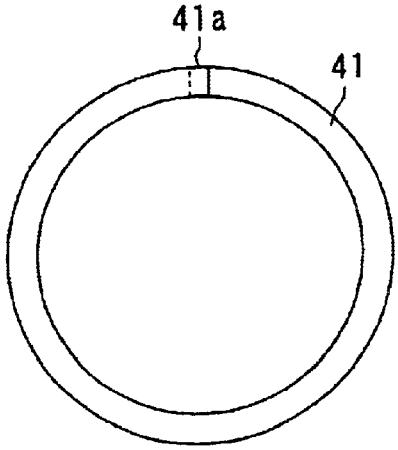
FIG. 3 is an illustration of the seal ring after being formed as a seal ring.

As briefly mentioned hereinbefore, the inside portion of the cylinder block 31 is sectioned into the lower and upper operation sections 32*a* and 32*b* by the seal ring 41 illustrated in FIGS. 2 and 3.

With reference to FIGS. 2 and 3, the seal ring 41 has an annular ring shape suitable for being fitted to the seal ring groove 42 formed to the outer peripheral surface of the roller 33 so as to tightly seal a space between the roller 33 and the cylinder block 31.

The seal ring 41 has a cutout 41*a* for easily fitting it to the roller 33, and the cutout end portions of the seal ring 41 have staged portions as shown in FIG. 2A for preventing fluid (gas) introduced into the operation section 32 from leaking through this cutout 41*a* after fitted to the seal ring groove 42. In general, if the seal ring is not provided with such cutout, it is difficult to fit it to the seal ring groove 42 tightly and make it substantially circle after fitted to the groove 42. Thus, the seal ring 41 is fitted to the seal ring groove 42 with the widened state at its cutout portion 41*a* and it provides a circular shape after the fitting as shown in FIG. 3.

In the above meaning, too, it is preferred for the seal ring 41 to be formed of a resin material. The use of the resin material will increase the sealing function of the seal ring 41 between the outer periphery of the roller 33 and the inner periphery of the cylinder block 31. In the case that the seal ring 41 is formed of the resin material, when the electric motor 6 is driven and the helical mechanisms 3, i.e., the roller 33 is eccentrically rotated, the seal ring 41 made of the resin material will finely change in its shape along the inner peripheral surface of the cylinder 31 to thereby further facilitating the sealing function.

More specifically, as a preferred resin material, there will be listed up: fluororesin such as PFA, PTFE; PPS resin; PEEK resin; or like, in which the fluororesin is more preferred in the viewpoint of abrasion.

Further, the cylinder block 31, as an objective material to the seal ring 41, will be preferably made of aluminium alloy. Specifically, A5056 and A6063 (JIS) will be more preferably utilized as roller 33 and cylinder 31. These members will be further preferred by effecting nickel-phosphorus based electroless plating in the viewpoint of abrasion.

Furthermore, with reference to FIG. 1, a lower (first) suction port 38 and a lower (first) drain port 43 are formed to the lower operation section 32*a* so as to be communicated with each other, and an upper (second) suction port 44 and an upper (second) drain port 45 are also formed to the upper operation section 32*b* so as to be communicated with each other. That is, the cooling media of low pressures are sucked through the suction ports 38 and 44 into the respective operation sections 32*a* and 32*b*, i.e., lower and upper compression chambers, and the cooling media of compressed high pressures are drained from the lower and upper drain ports 43 and 45, respectively.

The upper operation section 32*b*, constituting the upper compression chamber, is closed by a main bearing 37 to which the second drain port 45 is formed, and on the other hand, the lower operation section 32*a*, constituting the lower compression chamber, is closed by a sub-bearing 39 at a portion near the first suction port 38.

Further, an Oldham's ring 7 is disposed, as a rotation prevention mechanism, at a portion between the end surface of the roller 33 and the sub-bearing 39 so that when the roller 33 is eccentrically rotated, the roller 33 is revolved, but is not rotated.

According to such structure, when the electric motor 6 is driven, the roller 33 is revolved in the eccentric manner through the operation of the crank shaft 5, and according to this eccentric revolution of the roller 33, the blades 35*a* and 35*b* fitted to the helical grooves 34*a* and 34*b* perform their sliding motion therein. The lower and upper operation sections 32*a* and 32*b*, as the lower and upper compression chambers, are changed in their inner volumes so as to be continuously reduced from the lower side towards the upper side in the axial direction of the roller 33, respectively. According to this manner, an operation fluid, such as cooling medium, introduced into the lower and upper operation sections 32*a* and 32*b* through the first and second suction ports 38 and 44 are compressed in both the sections, independently, and then drained through the first and second drain ports 43 and 45 at the increased compressed pressures. The cooling medium drained from the second drain port 45 is then drained externally of the compressor 1 through a drain port 21 formed to an end cap 40 of the casing 2.

Thus, the fluid machinery, i.e., helical compressor of the described embodiment can achieve two compressing operations with different operating conditions. For example, both the operation sections may be operated as compressors, and on the other hand, the upper operation section 32*b* may be operated as compressor and the lower operation section 32*a* may be operated as pump.

That is, the first drain port 43 may be connected to a first cooling system, not shown, and the second drain port 45 may be connected to a second cooling system, not shown, to thereby constitute first and second cooling cycles. These connections may be performed at different conditions as well as same condition.

Further, the helical grooves 34*a* and 34*b* have sectional areas each providing a rectangular section, and the grooves 34*a* and 34*b* are formed with pitches gradually reduced from the lower side towards the upper side of the roller 33, i.e., in a state illustrated in FIG. 1.

The two helical grooves 34*a* and 34*b* may be formed with the same helical direction or reverse helical directions and at the same pitch or different pitches, respectively. These are optional design matters to be determined in accordance with compression conditions.

That is, the compression in both the operation sections 32*a* and 32*b* can be done in different modes by making different the groove shapes, pitches or like thereof.

Concerning the formation of the helical grooves, it may be generally desired that the winding direction of the helical grooves of both the operation sections 32*a* and 32*b* are made so as to provide a little pressure difference between both sides of the seal ring 41. That is, in a case that the drain pressure at the drain port 43 and the suction pressure at the suction port 44 are near in values, the leaking between both the operation sections 32*a* and 32*b* can be prevented by the location of the seal ring 41, and the compression efficiency as the helical compressor can be highly increased.

Furthermore, in a case that the helical grooves in both the operation sections are shifted by 180 degrees from each other in the rotating directions, changes in torque can be made further small even in the case of the helical grooves of the same winding directions.

Further, for example, in a case that both the operation sections 32*a* and 32*b* are formed as compressors having the same suction pressure and same drain pressure, it is desired to have a structure such that the winding directions of the helical grooves in both the operation sections are made reverse to each other and the suction ports or the drain ports of both operation sections 32*a* and 32*b* are positioned on both sides of the seal ring 41.

On the other hand, in a case that both the operation sections 32*a* and 32*b* are formed as compressors having the suction pressures different from each other and the drain pressures also different, it is desired to determine the winding directions of the helical grooves so that one suction port and one drain port, between which a pressure difference is made smallest, are positioned on both the sides of the seal ring 41.

Furthermore, in a case that one of the operation sections acts as an air compressor and the other one acts as a vacuum pump, it is desired that both the winding directions of the helical grooves are made same and the suction port of the air compressor and the drain port of the vacuum pump are positioned on both sides of the seal ring 41. In this case, there may be adopted: suction pressure of the air compressor of OkPa (atmospheric pressure); drain pressure of 10 to 100 kPa; and suction pressure of the vacuum pump of −20 to −60 kPa; drain pressure of OkPa (atmospheric pressure).

Figure 4:
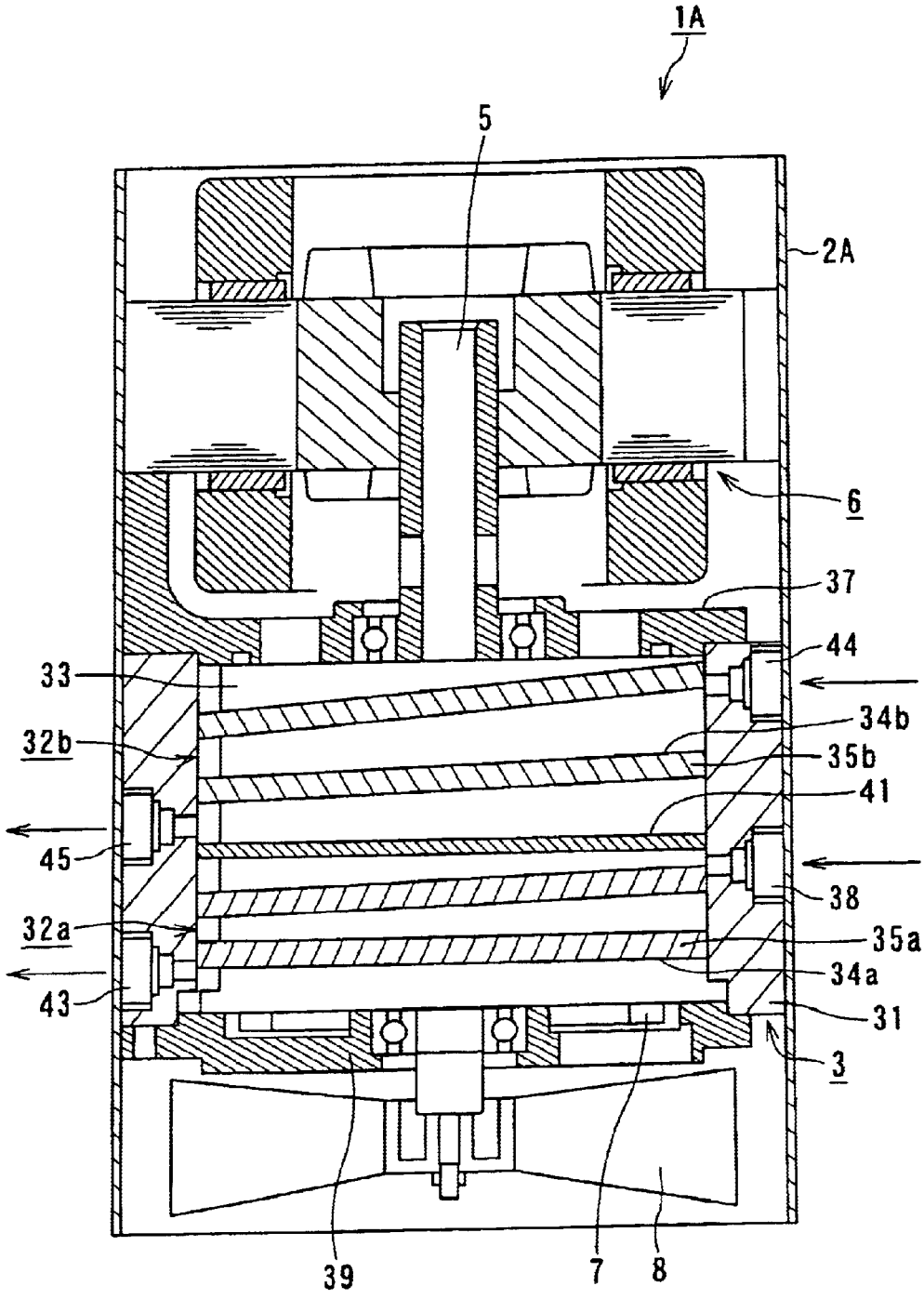
FIG. 4 is an elevational section of a helical compressor according to a second embodiment of the present invention.

FIG. 4 represents another (second) embodiment of a fluid machinery, as a helical compressor, of the present invention.

With reference to FIG. 4, this embodiment corresponds to the embodiment of FIG. 1 from which the outer seal casing 2 is replaced with an end opened cover 2A.

That is, the helical compressor 1A also comprises the helical mechanism 3 and the driving mechanism 6 such as electric motor, which drives the helical mechanism 3 through a crank shaft 5. In this embodiment, the outer casing 2 of the first embodiment is formed as hollow cylindrical cover 2A opened at its both longitudinal end portions, and a cooling fan 8 is hence mounted to an end portion of the crank shaft 5 at an inside end portion of the helical compressor 1A. The inside of the cylinder block 31 is also sectioned into a plurality of operation sections 32*a* and 32*b* as in the former embodiment. That is, the structures other than the end-opened cylindrical cover 2A are substantially the same as those of the aforementioned embodiment, and accordingly, the details thereof are omitted herein by adding the same reference numerals. In this second embodiment of FIG. 4, since the sealing casing 2 is not provided and opened at the end portion, all the suction ports 38, 44 and drain ports 43, 45 are directly communicated with an external portions, and accordingly, since the helical compressor 1A is utilized in the air, the atmospheric pressure may be utilized as suction pressure.

Figure 5:
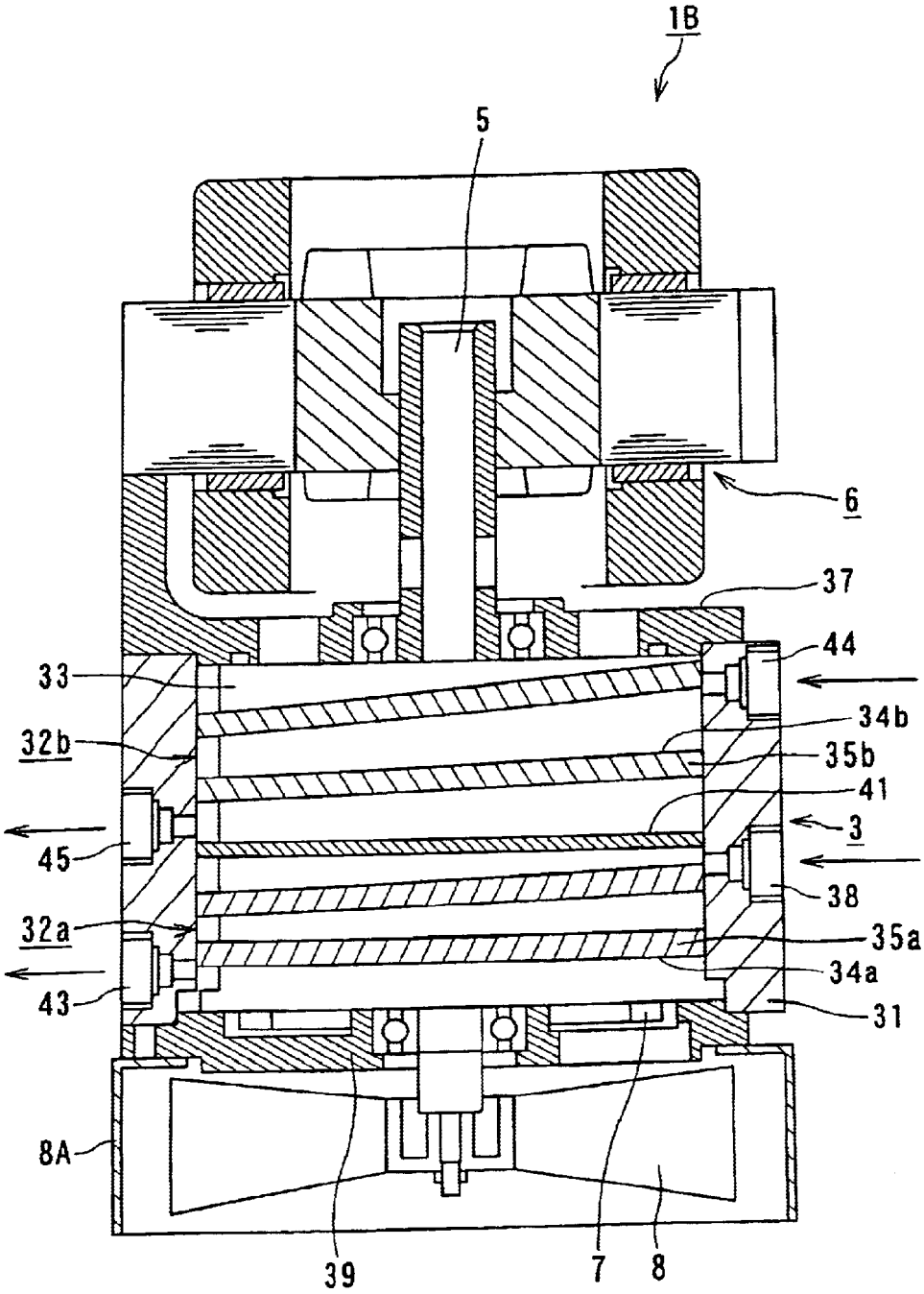
FIG. 5 is a modification of the second embodiment of the present invention.
Figure 6:
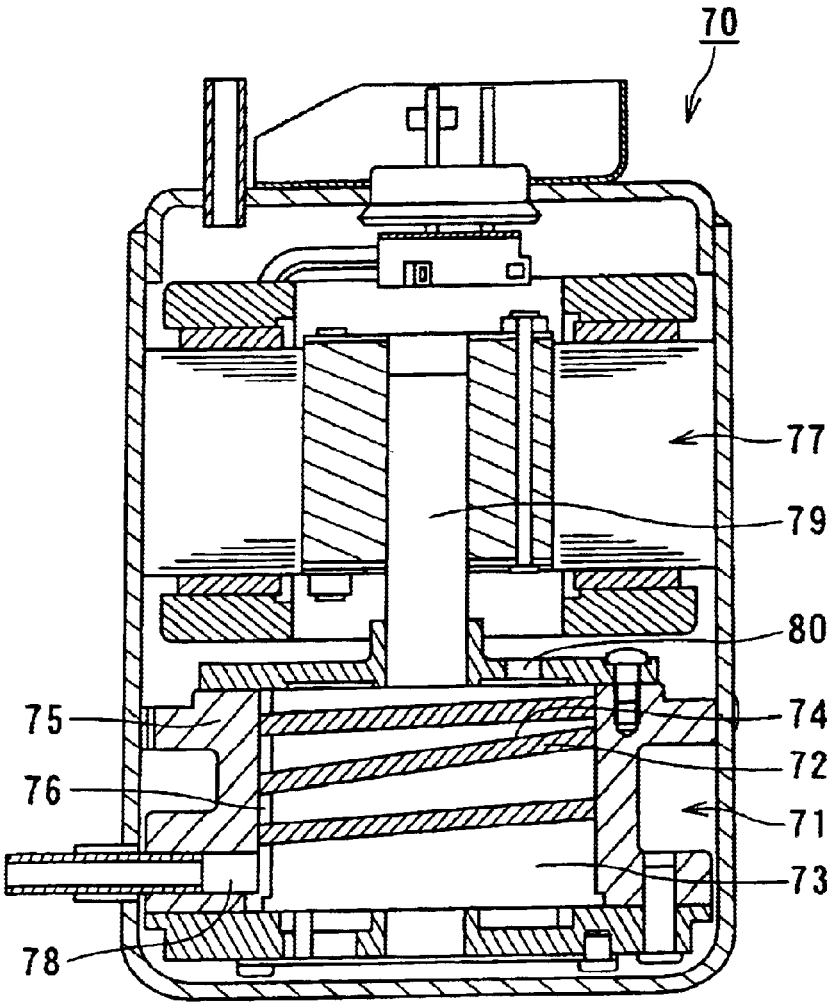
FIG. 6 PRIOR ART
FIG. 6 is an elevational section of a helical compressor as fluid machinery of a conventional structure having a single operation section.

Furthermore, FIG. 5 represent a modified embodiment of FIG. 4, in which a fluid machinery as a helical compressor 1B is shown, and this helical compressor 1B corresponds to that of FIG. 4 from which the end opened cover 2A is further eliminated and only a fan cover 8A is disposed.

That is, structures other than the above structure, in which the cylindrical cover 2A is removed, are substantially the same as those of the aforementioned embodiment of FIG. 4, and accordingly, explanations thereof are omitted herein by adding the same reference numerals as those of FIG. 4.

According to this modified embodiment, heat radiation effect can be improved.

Further, in the described embodiments, the inside portion of the cylinder block 31 of the helical mechanism 3 is sectioned into two (lower and upper) operation sections 32*a* and 32*b* by means of the seal ring 41. In a modified example, two or more seal rings 41 may be disposed so as to section the inside of the cylinder blocks 31 into two or, more operation sections which will be operated as compression chambers and/or pump chambers. Furthermore, the present invention may be applicable to fluid machineries, other than the helical compressor, such as vacuum pump or fluid pump, and hence, liquid as well as gas may be utilized as operation fluid.

That is, it is to be noted that the present invention is not limited to the described embodiments and many other changes and modifications may be made without departing from the scope of the appended claims.

What is claimed is:

1. A fluid machinery comprising a driving mechanism and a helical mechanism connected to the driving mechanism to be driven thereby through a crank shaft connected to the driving mechanism, said helical mechanism comprising:

a cylinder having an inner space as operation section;

a roller disposed in the inner space of the cylinder so as to be rotated by the driving mechanism through the crank shaft in an eccentric manner, said roller being formed with a plurality of helical grooves on an outer peripheral surface thereof and at least one seal ring groove formed on the outer peripheral surface of the roller at a portion between respective helical grooves;

a plurality of helical blades fitted to the helical grooves so as to be disposed between an inner peripheral surface of the cylinder and the outer peripheral surface of the roller;

at least one seal ring fitted to the seal ring groove so as to tightly seal a space between the inner peripheral surface of the cylinder and the outer peripheral surface of the roller so as to define the inner space of the cylinder into a plurality of operation sections; and a plurality of suction ports formed to the respective operation sections and a plurality of drain ports formed to the respective operation sections so that the corresponding suction port and drain port are communicated with each other.

2. A fluid machinery according to claim 1, wherein said seal ring has a cutout and end portions of the cutout are provided with staged portions which are tightly mated together when both end portions are assembled as a seal ring.

3. A fluid machinery according to claim 1, wherein said seal ring is formed of a resin material and, preferably, of a fluororesin.

4. A fluid machinery according to claim 1, wherein said helical grooves of the respective operation sections have same winding direction.

5. A fluid machinery according to claim 1, wherein said helical grooves of the respective operation sections have winding directions different from each other.

6. A fluid machinery according to claim 1, wherein said helical grooves of the respective operation sections have same winding pitch.

7. A fluid machinery according to claim 1, wherein said helical grooves of the respective operation sections have winding pitches different from each other.

8. A fluid machinery according to claim 1, wherein the driving mechanism and the helical mechanism are disposed in an outer cylindrical seal casing.

9. A fluid machinery according to claim 8, wherein said seal casing is replaced with a cylindrical cover having opened end portions.

10. A fluid machinery according to claim 1, which is composed of a vertical type helical compressor.

* * * * *